US007866665B2

(12) United States Patent
Takahashi et al.

(10) Patent No.: US 7,866,665 B2
(45) Date of Patent: Jan. 11, 2011

(54) SHEET CONVEYING DEVICE AND IMAGE FORMING APPARATUS

(75) Inventors: Masaki Takahashi, Yokohama (JP); Akihiko Enamito, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 231 days.

(21) Appl. No.: 12/026,722

(22) Filed: Feb. 6, 2008

(65) Prior Publication Data

US 2008/0211173 A1 Sep. 4, 2008

(30) Foreign Application Priority Data

Feb. 9, 2007 (JP) ..... P2007-030439

(51) Int. Cl.
*B65H 9/04* (2006.01)
*B65H 5/00* (2006.01)

(52) U.S. Cl. ..... 271/242; 271/10.03; 271/10.13; 271/110; 271/114; 271/266

(58) Field of Classification Search ..... 271/242, 271/110, 266, 114, 10.12, 10.13, 10.11, 10.04, 271/10.03
See application file for complete search history.

(56) References Cited

U.S. PATENT DOCUMENTS 5,119,146 A * 6/1992 Nobumori et al. ..... 399/396
5,197,726 A * 3/1993 Nogami ..... 271/110
5,393,044 A * 2/1995 Hagihara et al. ..... 271/10.04
5,471,290 A * 11/1995 Nagayama et al. ..... 399/371
5,482,265 A * 1/1996 Nakazato et al. ..... 271/242
6,397,035 B2 * 5/2002 Kataoka et al. ..... 399/388
6,533,263 B2 * 3/2003 Tamura ..... 271/10.01
6,757,515 B2 * 6/2004 Ueda ..... 399/396
7,068,969 B2 * 6/2006 Ueda ..... 399/388
7,292,819 B2 * 11/2007 Ueda ..... 399/381
7,308,853 B2 * 12/2007 Satoh et al. ..... 101/118

FOREIGN PATENT DOCUMENTS

JP 2004-167798 6/2004

* cited by examiner

*Primary Examiner*—Stefanos Karmis
*Assistant Examiner*—Luis Gonzalez
(74) *Attorney, Agent, or Firm*—Turocy & Watson, LLP

(57) ABSTRACT

A sheet conveying device includes: a feed unit that feeds sheets from a predetermined position; a conveying unit that conveys the sheets fed by the feed unit toward an image forming position at which images are to be formed on the respective sheets; and a registration unit that is provided at an upstream of the image forming position and positions the sheets by being bumped with the sheets conveyed by the conveying unit, wherein the feed unit and the registration unit are configured to operate so that a first timing at which a precedent sheet is bumped to the registration unit and a second timing at which a subsequent sheet is fed by the feed unit matches when a plurality of sheets are consecutively fed by the feed unit.

12 Claims, 6 Drawing Sheets

SHEET CONVEYING DEVICE AND IMAGE FORMING APPARATUS

RELATED APPLICATION(S)

The present disclosure relates to the subject matter contained in Japanese Patent Application No. 2007-030439 filed on Feb. 9, 2007, which is incorporated herein by reference in its entirety.

FIELD

The present invention relates to a sheet conveying device that conveys a sheet to an image forming position in an image forming apparatus, such as a copy machine and a printer, for improving operation noises during the conveyance of the sheet.

BACKGROUND

Various systems for forming an image have been adopted in an image forming apparatus, which forms images on a recording medium such as a sheet of paper, in order to reduce the size of the apparatus and increase the processing speed of the apparatus. For example, there are known systems for forming an image such as: an electrophotographic system that visualizes an electrostatic latent image formed on a photoreceptor drum by using a toner; an inkjet system that forms an image by directly discharging ink drops on the recording medium; and a silver salt photographic system that exposes a recorded image to a photoconductive dye.

In the various systems for forming an image, for example, after a sheet is fed from a sheet cassette or a manual feeding tray and positioned by registration rollers while being conveyed by a conveying device, the sheet is supplied to an image forming position. When the sheet is supplied to the image forming position, operation noises, such as driving noises of a feed roller and a conveying roller or an impact noise caused by the bump of the sheet against the registration rollers are generated.

In order to reduce the operation noises generated during supplying the sheets, there is proposed an apparatus that feeds the sheet from a cassette closest to an image forming device. See JP-A-2004-167798 for an example of such conventional sheet conveying device.

However, noises generated during supplying the sheets are caused by various factors, like impact noises that are due to the change of loads caused by sudden operation of the feed roller or the conveying roller from stopped state or impact noises that are caused by the impact of the sheets against the registration rollers. In particular, when images are consecutively formed, different kinds of sounds are continuously generated at several positions on a sheet conveyance path.

Meanwhile, the image forming apparatus is generally installed in an office. It is preferable that the operation noises of the apparatus would be fairly less under the office environment, and a sound pressure level of the operation sound is set as a product specification. However, even though the sound pressure level of the operation sound satisfies the product specification, there is a concern that the character of the operation sound of the apparatus deteriorates due to the impact noises related with the supply of the sheets.

For example, in a copy machine that prints sixty sheets per one minute, one sheet is conveyed per one second and images are then formed on the sheet. Further, while one sheet is conveyed, several impact noises, which are represented by onomatopoeic words of "click-click-tum-tum" or "tick-tick-pat-pat", are randomly generated per one second from several noise sources. There is a problem in that the above-mentioned operation noises are frequent and cause a user an uncomfortable feeling.

SUMMARY

According to a first aspect of the invention, there is provided a sheet conveying device including: a feed unit that feeds sheets from a predetermined position; a conveying unit that conveys the sheets fed by the feed unit toward an image forming position at which images are to be formed on the respective sheets; and a registration unit that is provided at an upstream of the image forming position and positions the sheets by being bumped with the sheets conveyed by the conveying unit, wherein the feed unit and the registration unit are configured to operate so that a first timing at which a precedent sheet is bumped to the registration unit and a second timing at which a subsequent sheet is fed by the feed unit matches when a plurality of sheets are consecutively fed by the feed unit.

According to a second aspect of the invention, there is provided an image forming apparatus including: at least one of a sheet cassette and a tray that receives a stack of sheets; an image forming device that forms images on the respective sheets at an image forming position; and a sheet conveying device that includes: a feed unit that feeds the sheets from the sheet cassette or the tray; a conveying unit that conveys the sheets fed by the feed unit toward the image forming position; and a registration unit that is provided at an upstream of the image forming position and positions the sheets by being bumped with the sheets conveyed by the conveying unit, wherein the feed unit and the registration unit are configured to operate so that a first timing at which a precedent sheet is bumped to the registration unit and a second timing at which a subsequent sheet is fed by the feed unit matches when a plurality of sheets are consecutively fed by the feed unit.

DETAILED DESCRIPTION OF THE EMBODIMENTS

Figure 1:
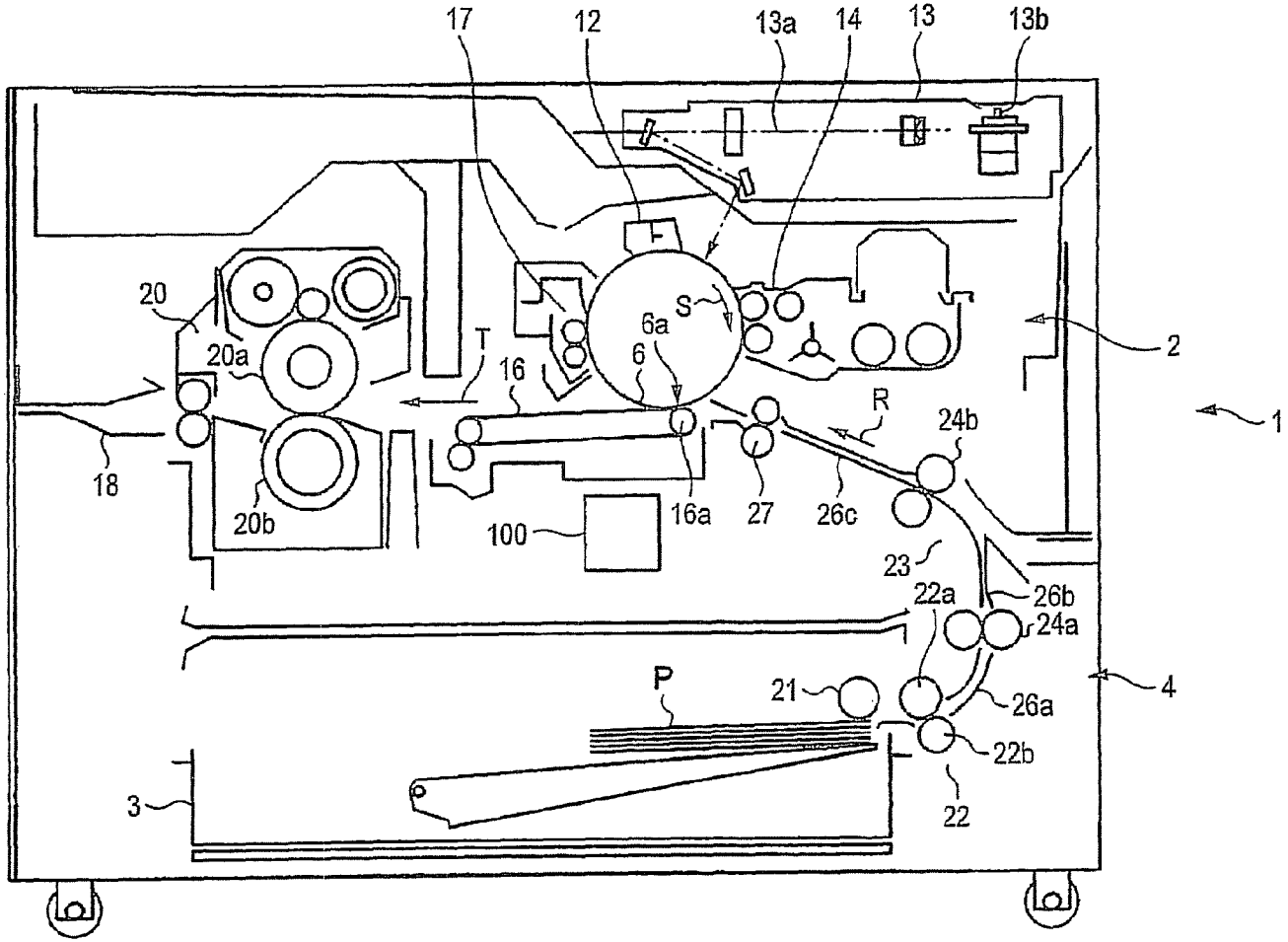
FIG. 1 is a schematic view showing the structure of an electrophotographic printer according to an embodiment of the invention.

A preferred embodiment of the invention will be described in detail below with reference to FIGS. 1 to 5. FIG. 1 is a schematic view showing the structure of an electrophotographic printer 1 that is an image forming apparatus.

The electrophotographic printer includes a sheet conveying device 4 that serves as a sheet conveying device according to the invention. A sheet cassette 3, which receives sheets P used as recording media to be fed to an image forming device 2, is provided at a predetermined position on the lower portion of the printer 1. The sheet cassette 3 receives sheets P having a standard size that are sheets P having an A4 width prescribed by JIS standard. A sheet conveying device 4 is provided between the sheet cassette 3 and the image forming device 2.

The electrophotographic printer also includes a controller 100 that controls operation by the components described above.

The image forming device 2 includes a photoreceptor drum 6, a charging unit 12, a laser exposure unit 13, a developing unit 14, a transfer belt 16, and a cleaner 17. The charging unit, the laser exposure unit, the developing unit, the transfer belt, and the cleaner are sequentially provided around the photoreceptor drum 6 in a rotational direction of the photoreceptor drum 6, which is indicated by an arrow s. A photographic sensitive material, of which conductivity is changed due to a laser beam or the like, is applied on the surface of the photoreceptor drum 6. The charging unit 12 uniformly charges the surface of the photoreceptor drum 6 at several hundreds volts. The laser exposure unit 13 applies a laser beam 13*a*, which is radiated by a polygon mirror 13*b* on the basis of image data, onto the surface of the photoreceptor drum 6, and thus forms an electrostatic latent image on the surface of the photoreceptor drum 6.

The transfer belt 16 faces a transfer position 6*a* that is an image forming position of the photoreceptor drum 6, and a required transfer voltage is applied to the transfer belt by a transfer roller 16*a*.

A sheet ejecting conveyance path 18, along which a sheet P having a transferred toner image is conveyed in a sheet ejection direction, is provided at the downstream of the photoreceptor drum 6 in a conveying direction of the sheet P that is indicated by an arrow T shown in FIG. 1. A fixing unit 20 is provided on the sheet ejecting conveyance path 18. The fixing unit includes a heat roller 20*a* and a pressure roller 20*b* for heating, pressing, and fixing a toner image that is formed on the sheet P separated from the photoreceptor drum 6.

The sheet conveying device 4 will be described in detail below. The sheet conveying device 4 includes a pick-up roller 21, a separation roller 22 including an upper separation roller 22*a* and a lower separation roller 22*b*, and a conveying unit 23. The pick-up roller is a feed roller that feeds the sheets P from the sheet cassette 3. The separation roller prevents the double-feed (a situation where two or more sheets P are fed at the same time) of the fed sheets P. The conveying unit conveys the separated uppermost sheet P toward the transfer position 6*a* of the photoreceptor drum 6, which is indicated by an arrow R shown in FIG. 1. The conveying unit 23 includes conveying rollers 24*a*, and 24*b*, and conveyance guides 26*a*, 26*b*, and 26*c*. Further, the sheet conveying device 4 includes registration rollers 27 that serve as a registration unit for adjusting the position of the sheet P conveyed by the conveying unit 23 before the sheet is fed to the transfer position 6*a* of the photoreceptor drum 6.

The registration rollers 27 are provided with a drive mechanism using a stepping motor (not shown), and the conveying rollers 24*b* are also provided with a drive mechanism using a stepping motor independent of the stepping motor. The sheet P is conveyed by these drive mechanisms, and the front edge of the sheet P is conveyed by the conveying rollers 24*b* and thus bumped against a nip portion between the stopped registration rollers 27. This operation is a positioning operation (registration) when the sheet P is conveyed while being slightly skew with respect to the conveying direction. The stepping motor for driving the conveying rollers 24*b* is stopped immediately after the front edge of the sheet P is bumped against the nip portion between the registration rollers 27. Then, the stepping motor for driving the registration rollers 27 is driven so as to convey the sheet P.

Figure 2:
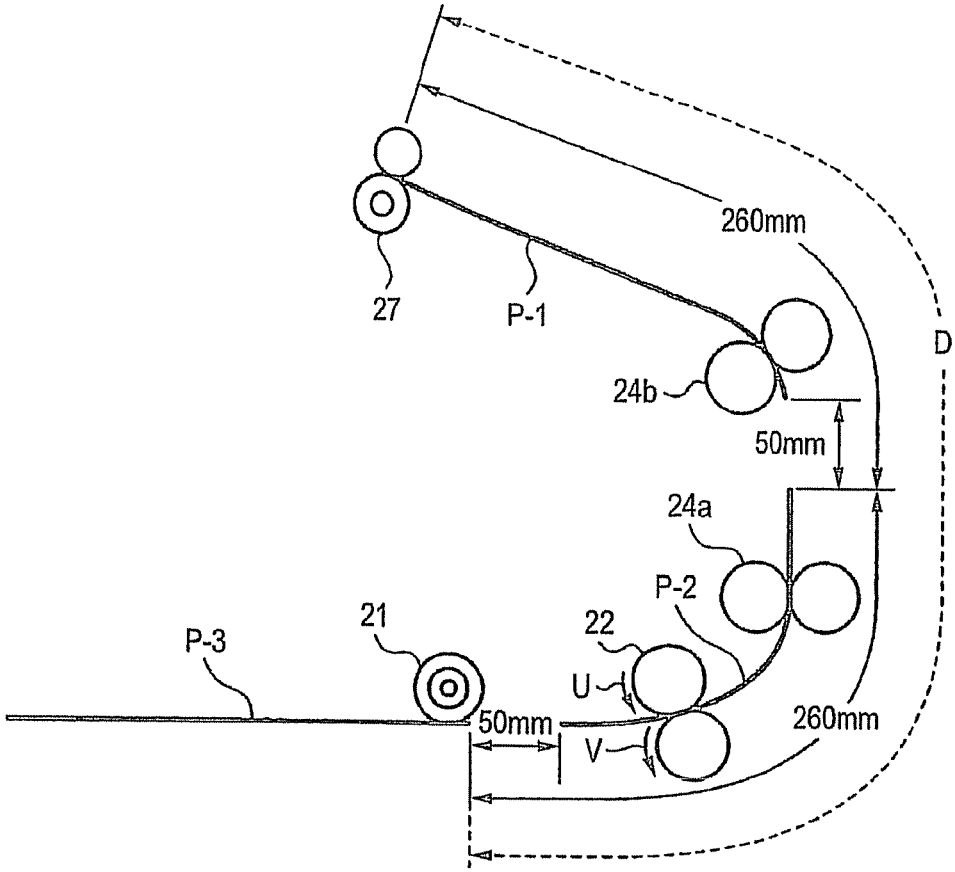
FIG. 2 is a schematic view showing a sheet conveying device according to the embodiment.
Figure 3:
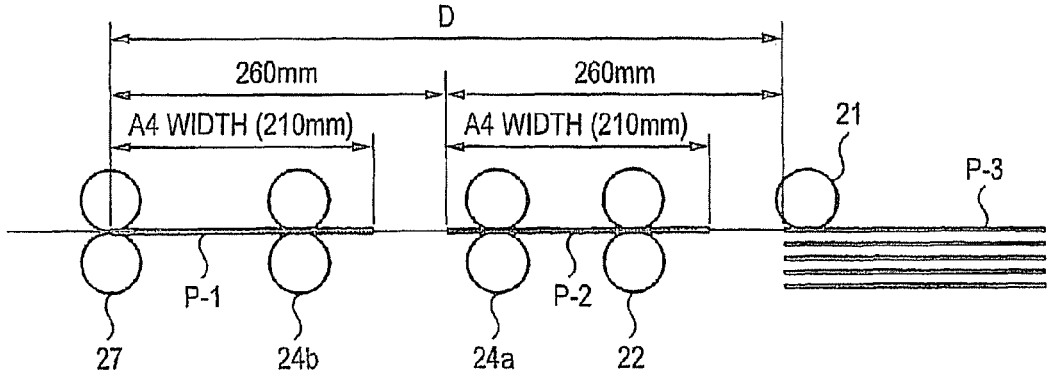
FIG. 3 is a schematic view showing that the sheet conveying device according to the embodiment is developed on a plane.

As shown in FIGS. 2 and 3, a distance D, which is a conveying distance between the pick-up roller 21 and the registration rollers 27 of the sheet conveying device 4, is twice as long as a distance between the front edge PS1 of a precedent sheet P-1 having an A4 width based on the JIS standard and the front edge PS2 of a subsequent sheet P-2. Actually, the distance D is twice as long as 260 mm that is the sum of the A4 width (210 mm) based on the JIS standard and a gap (50 mm) between the sheets. If the distance D is set as described above, the generation timings of noises when the sheets P are continuously fed to the transfer position 6*a* correspond to each other.

Figure 4:
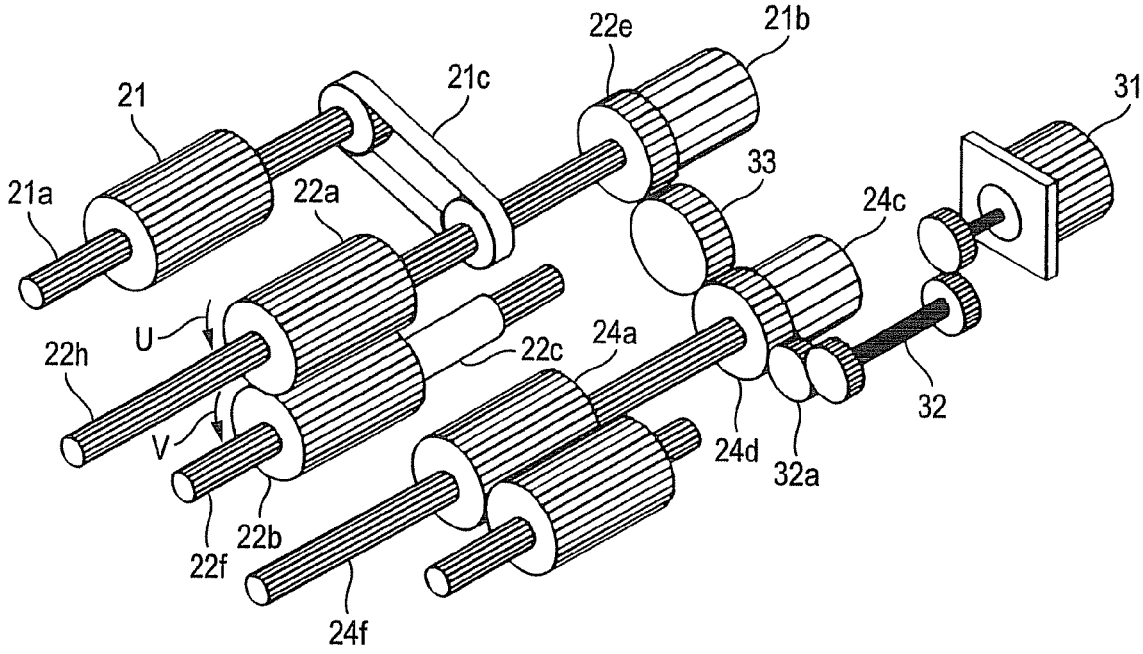
FIG. 4 is a schematic view showing the structure of a drive unit according to the embodiment.

The sheet conveying device 4 drives the pick-up roller 21, the separation roller 22, and the conveying rollers 24*a* by using a drive unit 30 shown in FIG. 4. A driving force applied to each of the rollers is generated by a motor 31, and is transmitted to each of the rollers by a link mechanism 32. As for the conveying rollers 24*a*, a driving force is transmitted to a conveying gear 24*d*, which is connected to a conveying electromagnetic clutch 24*c*, by a gear 32*a* of the link mechanism 32. When internal clutch plates of the conveying electromagnetic clutch 24*c* are connected to each other by applying current, the conveying gear 24*d* is connected to a conveying shaft 24*f*, so that the conveying rollers 24*a* are rotated.

A driving force is transmitted from the conveying gear 24*d* to an upper separation roller gear 22*e*, which is connected to a pick-up electromagnetic clutch 21*b*, by an idle gear 33.

The upper separation roller gear 22*e* is connected to an upper shaft 22*h* by applying current to the pick-up electromagnetic clutch 21*b*. A driving force is transmitted to a pick-up roller shaft 21*a* by a timing belt 21*c*. Accordingly, the pick-up roller 21 and the upper separation roller 22*a* are rotated by applying current to the pick-up electromagnetic clutch 21*b*.

The lower separation roller 22*b* is rotatably supported by a fixed lower shaft 22*f*.

Meanwhile, the separation roller 22 is configured by the upper separation roller 22*a* and the lower separation roller 22*b*. The lower separation roller 22*b* is connected to the lower shaft 22*f* by a torque limiter 22*c*. That is, when the double-feed of the sheets P occurs, a conveying force of the upper separation roller 22*a* and a brake force of the lower separation roller 22*b* become larger than a frictional force between the sheets P. Accordingly, the uppermost sheet P, which comes in contact with the upper separation roller 22*a* rotated in a direction indicated by an arrow U shown in FIG. 2, is conveyed toward the conveying rollers 24*a*, and the second or later sheet P is stayed at the position of the separation roller 22 that is urged toward a direction indicated by an arrow V shown in FIG. 2.

Since the sheet conveying device 4 having the above-mentioned structure makes the sheet P be bumped against the registration rollers 27 during the conveyance of the sheet P, an impact noise is generated. Further, when current is applied to the pick-up electromagnetic clutch 21*b* for transmitting the driving force to the pick-up roller 21 and the separation roller 22 and when current is applied to the conveying electromagnetic clutch 24*c* for transmitting the driving force to the conveying rollers 24*a*, impact noises are generated due to the sudden change of loads.

Figure 5:
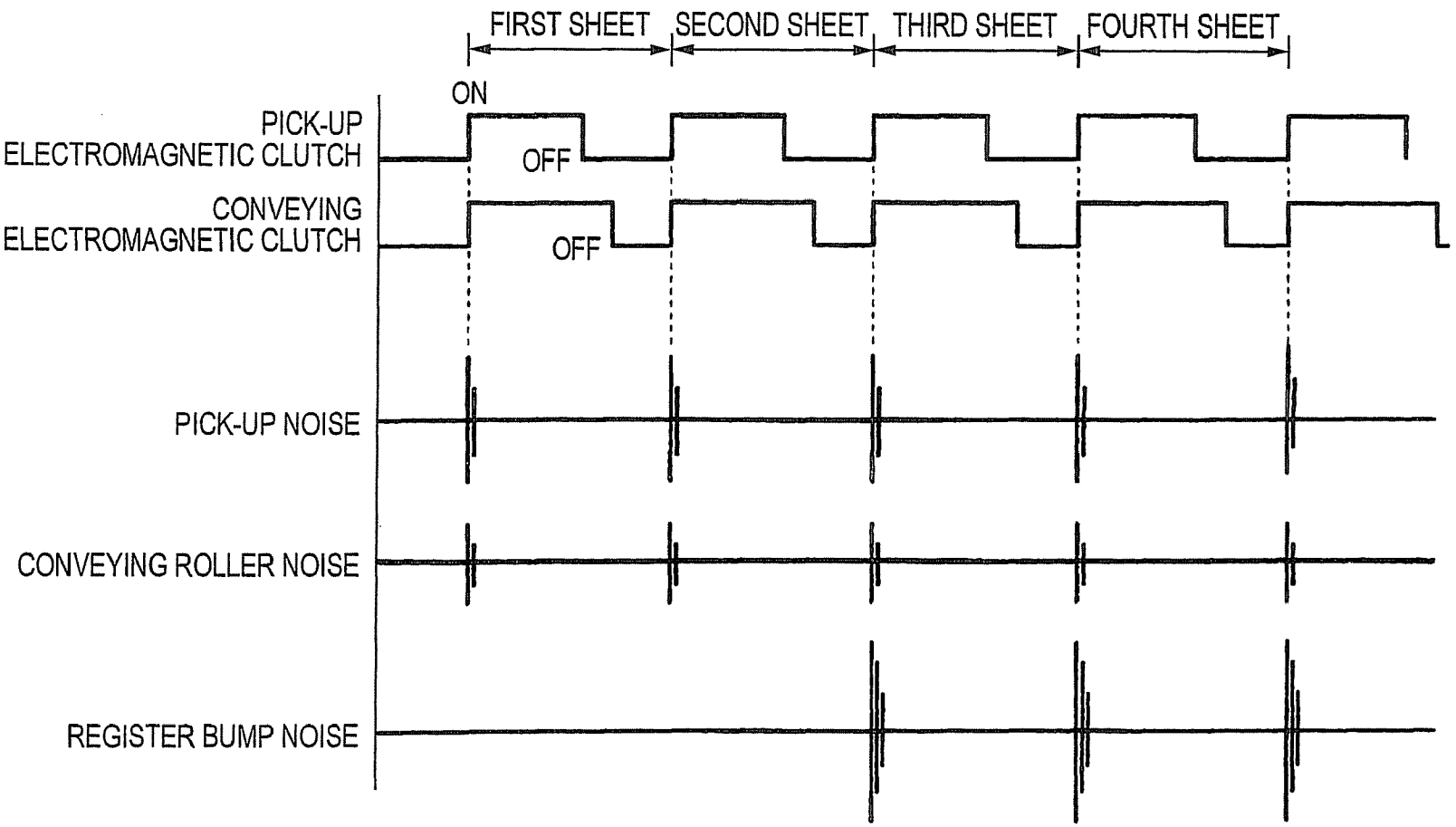
FIG. 5 is a timing chart showing driving timings of the drive units and the generation of impact noises in the sheet conveying device according to the embodiment.

In this embodiment, the sheet conveying device 4 controls the current applied to the pick-up electromagnetic clutch 21*b* and the conveying electromagnetic clutch 24*c* so that the generation timings of the impact noises generated at components correspond to each other as shown in FIG. 5.

That is, current is simultaneously applied to the pick-up electromagnetic clutch 21*b* and the conveying electromagnetic clutch 24*c* in this embodiment, so that the sheet P begins to be conveyed. After the front edge of the sheet P reaches the conveying rollers 24*a* and a conveying force of the conveying rollers 24*a* is transmitted to the sheet P, current applied to the pick-up electromagnetic clutch 21*b* is cut off immediately before the rear end of the sheet P passes by the pick up roller 21. Meanwhile, the current applied to the conveying electromagnetic clutch 24*c* is cut off immediately before the rear end of the sheet P passes by the conveying rollers 24*a* after the current applied to the pick-up electromagnetic clutch 21*b* is cut off. In this case, the sheet P is conveyed by the conveying rollers 24*b* that are driven by an independent stepping motor.

When the front edge of the precedent sheet P is conveyed by a distance of 260 mm from the position of the pick-up roller 21 during the continuous image formation, current is controlled to begin to be simultaneously applied to the pick-up electromagnetic clutch 21*b* and the conveying electromagnetic clutch 24*c* again for the purpose of feeding and conveying the subsequent sheet P. In the case of the third or later sheet during the repetition of this operation, the generation timing of the impact noises when current is applied to the pick-up electromagnetic clutch 21*b* and the conveying electromagnetic clutch 24*c* for the purpose of feeding and conveying the subsequent sheet P completely corresponds to the generation timing of the impact noises when the precedent sheet P is bumped against the registration rollers 27.

That is, when images are continuously formed, impact noises that are generated from a plurality of generation sources and impact noises generated during the conveyance of one sheet P are mixed to each other, so that impact noises corresponding to one time are generated. For example, if the printer 1 prints sixty sheets per one minute, one impact noise that can be represented by an onomatopoeic word of "click" or "tick" is generated per one second.

Figure 6:
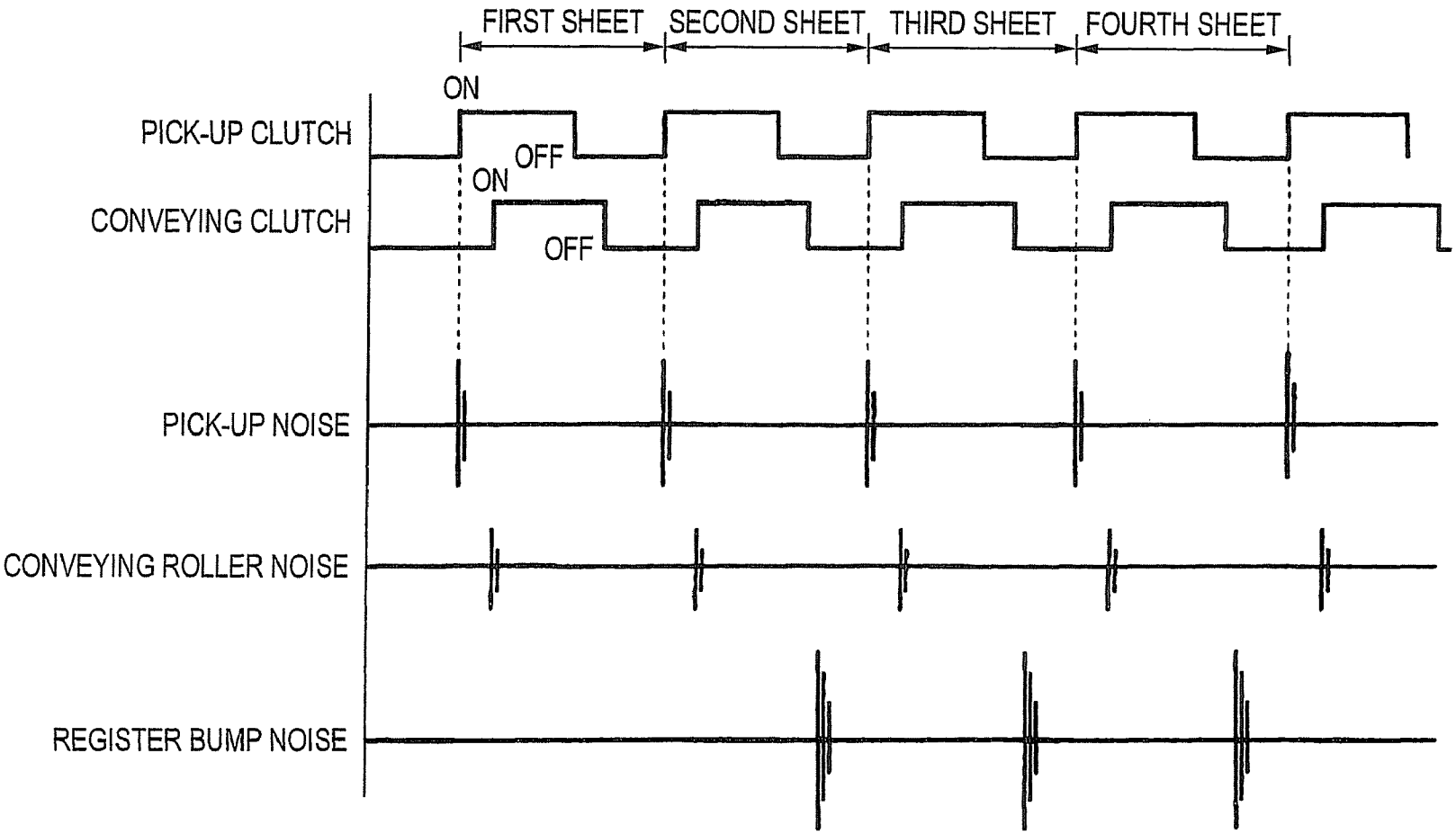
FIG. 6 is a timing chart showing driving timings of drive units and the generation of impact noises in a sheet conveying device in the related art, as a comparative example.

In contrast, when images are continuously formed, for example, as shown as a comparative example in FIG. 6, three different kinds of sounds that have different sound pressure levels of the impact noises are sporadically generated during the conveyance of one sheet P as the noises generated from an apparatus in the related art where the generation timings of the impact noises generated from a plurality of generation sources during the continuous image formation are different from each other. Accordingly, very frequent operation noises are generated. That is, an impact noise, of which sound pressure level is not particularly high, is also individually recognized in the apparatus in the related art where the generation timings of the impact noises are not considered. For this reason, the office environment deteriorates due to frequent operation noises.

In this embodiment, the pick-up electromagnetic clutch 21*b* and the conveying electromagnetic clutch 24*c* are controlled to be ON and OFF by the controller 100. However, the pick-up electromagnetic clutch 21*b* and the conveying electromagnetic clutch 24*c* may be controlled by a dedicated controller that is provided separately from the controller 100.

Even though the pick-up electromagnetic clutch 21*b* and the conveying electromagnetic clutch 24*c* are controlled to be ON and OFF so that the generation timings of the impact noises generated at the pick-up electromagnetic clutch 21*b*, the conveying electromagnetic clutch 24*c*, and the registration rollers 27 completely correspond to each other, the variation of the impact noises may occur due to the control accuracy or the conveying accuracy of the sheet P.

How much time difference with respect to human's auditory sense between the plurality of sound sources the human can perceive as a plurality of sound sources has been researched in connection with a study of a high-efficiency voice compression encoding system. One example of such research is disclosed on pp. 18-23 Miyasaka of "Vol. 60#1, Journal of Japanese Acoustical Society", published by an Acoustical Society of Japan in 2004. In general, when having time difference in the range of about 50 to 200 ms, a plurality of sound sources is perceived.

Accordingly, when the image forming apparatus prints sixty sheets having an A4 width per one minute in this embodiment, the positional error of each roller is allowed up to about 15.5 mm (=310×0.05) in order to set the conveying speed of the sheet to 310 mm/s, for example, in order to set the time difference within 50 ms. Since this is in the range sufficiently realizable to design an apparatus, it is recognized that it is possible to allow the above-mentioned generation timings of the impact noises to correspond to each other at a degree that cannot be perceived by a human.

Further, when the impact noises are overlapped, it is possible to expect a masking effect. The masking effect is a effect that the minimum audible field of a target sound rises due to other sounds. When the impact noises are overlapped as described above, an impact noise having a high sound pressure level is heard, so that other impact noises to be masked are not perceived.

The operation will be described below. For example, when a continuous image forming operation begins to be performed on a sheet having an A4 width, image forming processes are sequentially performed on the surface of the photoreceptor drum 6 in the image forming device 2 while the photoreceptor drum 6 is rotated in the direction indicated by the arrow S shown in FIG. 1. The photoreceptor drum 6 is uniformly charged by the charging unit 12, and the laser exposure unit 13 then radiates a laser beam based on document information onto the photoreceptor drum, so that an electrostatic latent image is formed on the photoreceptor drum. After that, the electrostatic latent image is developed by the developing unit 14, so that a toner image is formed on the photoreceptor drum 6.

The toner image formed on the photoreceptor drum 6 is transferred onto the sheet P that is conveyed to the transfer belt 16 by the sheet conveying device 4 in synchronization with the toner image formed on the photoreceptor drum 6. The transfer of the toner image formed on the photoreceptor drum 6 onto the sheet P is performed by applying high-voltage transfer bias to the transfer roller 16*a* at the nip portion where the transfer belt 16 comes in contact with the photoreceptor drum 6 so as to electrically attach the toner image onto the surface of the sheet P. Subsequently, after being separated from the photoreceptor drum 6, the sheet P is conveyed to the fixing unit 20 and passes through the nip between the heat roller 20*a* heated at a fixable temperature and the pressure roller 20*b*. Accordingly, the toner image is heated, pressed, and fixed on the sheet. After the toner image is transferred onto the sheet P, the photoreceptor drum 6 is cleaned by the cleaner 17 so that the next toner image can be formed.

The continuous feeding of the sheets P, which is performed by the sheet conveying device 4, will be described below. The motor 31 is driven in the drive unit of the sheet conveying device 4 due to the beginning of the continuous image forming operation. The driving of the motor 31 causes the pick-up roller 21 and the separation roller 22 to be intermittently operated by the pick-up electromagnetic clutch 21*b*. The driving of the motor 31 causes the conveying rollers 24*a* to be intermittently operated by the conveying electromagnetic clutch 24*c*.

First, when the first sheet P is fed, current is simultaneously applied to the pick-up electromagnetic clutch 21*b* and the conveying electromagnetic clutch 24*c*. Accordingly, the sheet P is fed from the sheet cassette 3 by the pick-up roller 21, and the only uppermost sheet P is conveyed to the conveyance guide 26*a* by the separation roller 22 and thus separated and fed toward the conveying rollers 24*a*. Then, the first sheet P is clamped and conveyed by the conveying rollers 24*a*, and conveyed toward the conveying rollers 24*b* through the conveyance guide 26*b*.

In this case, when the front edge of the sheet P reaches the conveying roller 24*a* and a conveying force of the conveying roller 24*a* is transmitted to the sheet P, current applied to the pick-up electromagnetic clutch 21*b* is cut off. Further, the current applied to the conveying electromagnetic clutch 24*c* is cut off immediately before the rear end of the sheet P passes by the conveying rollers 24*a* after the current applied to the pick-up electromagnetic clutch 21*b* is cut off.

After that, when the front edge of the first sheet P-1 reaches a position distant from the pick-up roller 21 by a distance of 260 mm, current is simultaneously applied to the pick-up electromagnetic clutch 21*b* and the conveying electromagnetic clutch 24*c* again. Accordingly, like the first sheet P-1, after the second sheet P-2 is fed from the sheet cassette 3 and separated, the second sheet is conveyed toward the conveying rollers 24*b* by the conveying rollers 24*a*.

In this case, the first sheet P-1 is conveyed toward the registration rollers 27 through the conveyance guides 26*b* and 26*c* by the conveying rollers 24*a*, and 24*b*.

After that, when the front edge of the second sheet P-2 reaches a position distant from the pick-up roller 21 by a distance of 260 mm, current is simultaneously applied to the pick-up electromagnetic clutch 21*b* and the conveying electromagnetic clutch 24*c* again. Accordingly, like the first sheet P-1 and the second sheet P-2, after the third sheet P-3 is fed from the sheet cassette 3 and separated, the third sheet is conveyed toward the conveying rollers 24*b* by the conveying rollers 24*a*.

In this case, the second sheet P-2 is conveyed toward the registration rollers 27 through the conveyance guides 26*b* and 26*c* by the conveying rollers 24*a*, and 24*b*. Further, the first sheet P-1 reaches the registration rollers 27, and the front edge of the sheet P-1 is bumped against the nip between the registration rollers 27. When the third sheet P-3 is fed, an impact noise when current is applied to the pick-up electromagnetic clutch 21*b*, an impact noise when current is applied to the conveying electromagnetic clutch 24*c*, and an impact noise caused by the bump of the front edge of the sheet P against the registration rollers 27 are generated in the sheet conveying device 4.

Since current is simultaneously applied to the pick-up electromagnetic clutch 21*b* and the conveying electromagnetic clutch 24*c*, the generation timings of the impact noises generated due to the sudden change of loads of the electromagnetic clutches 21*b* and 24*c* correspond to each other as shown in FIG. 5. Further, since the distance D between the pick-up roller 21 and the registration rollers 27 of the sheet conveying device 4 is set to be twice as long as the distance between the front edge PS1 of the precedent sheet P-1 having an A4 width and the front edge PS2 of the subsequent sheet P-2, the generation timings of the impact noises caused by the bump of the front edge of the sheet P against the registration rollers 27 also correspond to each other.

Accordingly, when sheets are continuously fed, three impact noises generated from the sheet conveying device 4 are mixed to each other, so that an impact noise corresponding to one time is generated. That is, if the printer 1 according to this embodiment prints sixty sheets per one minute, one impact noise represented by "click" or "tick" noise is generated per one second.

After that, while the subsequent sheets P are continuously fed, one regular and steady operation sound, which is represented by "click" or "tick" noise, is generated per one second from the sheet conveying device 4.

When the sheets P having an A4 width (the length of the sheet is 210 mm in a conveying direction) are continuously conveyed, a gap between the sheets is set to 50 mm in this embodiment. Accordingly, when images are formed on the basis of the different image information for each page, it is possible to ensure time that is required to exchange data of the image information of the preceding and the succeeding pages in an image memory. Further, even though the manufacturing accuracy of the sheet conveying device 4 has variation, or even though the control accuracy of each of the drive units has variation, there is no concern that the rear end of the precedent sheet and the front edge of the subsequent sheet overlap each other, because a sufficient gap is ensured between the sheets.

The improvement of the impact noises generated when sheets having an A4 width are continuously fed has been described in this embodiment. However, the size of the sheet is not limited to A4, and the embodiment can be applied to the sheets having other size. In addition, for example, if the size of the sheet received in each of sheet cassettes is predetermined in the case of an image forming apparatus including a plurality of multistage sheet cassettes, it is possible to improve the impact noises during the continuous feeding of the sheets that have the predetermined size and are received in the each sheet cassette. In this case, if a distance between a feed unit of each sheet cassette and a registration unit is set to an integer multiple of a distance between the front edges of the preceding and subsequent sheets that are received in the sheet cassette and have the predetermined size, it is possible to easily allow the generation timing of the impact noises, which are generated in the feed unit of the sheet cassette during the continuous feeding of the sheets, to correspond to the generation timing of the impact noises that are caused by the bump of the sheets against the registration unit. Actually, for example, a distance between a feed unit of the upper sheet cassette and the registration unit may be set to be twice as long as a distance between the front edge of the precedent sheet and the front edge of the subsequent sheet. A distance between a feed unit of the lower sheet cassette and the registration unit may be set to be three times as long as a distance between the front edge of the precedent sheet and the front edge of the subsequent sheet.

According to this embodiment, the distance D between the pick-up roller 21 and the registration rollers 27 of the sheet conveying device 4 is set to be twice as long as the distance between the front edge PS1 of the precedent sheet P-1 having an A4 width and the front edge PS2 of the subsequent sheet P-2, and current is simultaneously applied to the pick-up electromagnetic clutch 21*b* and the conveying electromagnetic clutch 24*c*. Further, during the continuous feeding of the sheets, the generation timing of the impact noises when the third sheet P-3 is fed by the pick-up roller 21 is allowed to correspond to the generation timing of the impact noises that are caused by the bump of the first sheet P-1 against the registration rollers 27.

Accordingly, the impact noises generated from the sheet conveying device 4 during the continuous feeding of the sheets can be changed into regular and steady operation noises, that is, operation noises having the regular timing of once per one second. As a result, even when the printer 1 is installed in an office, it is possible to reduce office worker's uncomfortable feeling caused by the operation noises of the sheet conveying device 4 in an environmental space where the printer is mounted. For this reason, the office environment is improved at a location where the printer 1 is installed, so that it is possible to increase the degree of freedom at a location where the printer 1 is installed.

The present invention is not limited to the above-mentioned embodiment, and may be modified without the change of the purpose thereof. For example, the image forming apparatus may be a color apparatus. Further, the recording media may be fed from a manual tray, which is provided at a predetermined position, as well as may be fed from the sheet cassette. However, in this case, if a distance between a feed unit of the manual tray and a registration unit is set to be an integer multiple of a distance between the front edges of the preceding and subsequent sheets having a predetermined size, it is possible to easily allow the generation timing of the impact noises, which are generated in the feed unit of the manual tray during the continuous feeding of the sheets, to correspond to the generation timing of the impact noises, which are caused by the bump of the sheets against the registration unit.

Meanwhile, when the image forming apparatus includes a plurality of sheet cassettes and sheets having various sizes can be continuously fed, operation noises may not be improved as for all kinds of sheets but may be improved as for only the kind of sheets that is most frequently used.

It is to be understood that the invention is not limited to the specific embodiment described above and that the invention can be embodied with the components modified without departing from the spirit and scope of the invention. The invention can be embodied in various forms according to appropriate combinations of the components disclosed in the embodiment described above. For example, some components may be deleted from all components shown in the embodiment. Further, the components in different embodiments may be used appropriately in combination.

What is claimed is:

1. A sheet conveying device comprising:

a motor, a controller, a feed unit that feeds sheets from a predetermined position;

a conveying unit that conveys the sheets fed by the feed unit toward an image forming position at which images are to be formed on the respective sheets; and a registration unit that is provided at an upstream of the image forming position and positions the sheets by being bumped with the sheets conveyed by the conveying unit, wherein the feed unit and the registration unit are configured to operate so that a first timing at which a precedent sheet is bumped to the registration unit and a second timing at which a subsequent sheet is fed by the feed unit matches when a plurality of sheets are consecutively fed by the feed unit, wherein the feed unit is provided with a feed roller and a first electromagnetic clutch that links the feed roller to the motor, and wherein the controller controls the first electromagnetic clutch to control that the first timing and the second timing matches.

2. The device according to claim 1, wherein a conveying distance of the sheet in the conveying unit between the feed unit and the registration unit is set to an integer multiple of a distance between a front edge of the precedent sheet and a front edge of the subsequent sheet to match the first timing and the second timing.

3. The device according to claim 2, wherein the conveying distance is set to satisfy the integer multiple for a most frequently used size of the sheets from among a plurality of sizes of conveyable sheets.

4. The device according to claim 1, wherein the feed unit is linked with a driving source at the second timing.

5. The device according to claim 1, wherein the conveying unit is linked with a driving source at the first timing so as to bump the sheets to the registration unit.

6. The device according to claim 1 further wherein the conveying unit is provided with a conveying roller and a second electromagnetic clutch that links the conveying roller to the motor, and wherein the controller controls the first electromagnetic clutch and the second electromagnetic clutch to control that the first timing and the second timing matches.

7. An image forming apparatus comprising:

a motor, a controller, at least one of a sheet cassette and a tray that receives a stack of sheets;

an image forming device that forms images on the respective sheets at an image forming position; and a sheet conveying device that includes:

a feed unit that feeds the sheets from the sheet cassette or the tray;

a conveying unit that conveys the sheets fed by the feed unit toward the image forming position; and a registration unit that is provided at an upstream of the image forming position and positions the sheets by being bumped with the sheets conveyed by the conveying unit, wherein the feed unit and the registration unit are configured to operate so that a first timing at which a precedent sheet is bumped to the registration unit and a second timing at which a subsequent sheet is fed by the feed unit matches when a plurality of sheets are consecutively fed by the feed unit, wherein the feed unit is provided with a feed roller and a first electromagnetic clutch that links the feed roller to the motor, wherein the controller controls the first electromagnetic clutch to control that the first timing and the second timing matches.

8. The apparatus according to claim 7, wherein a conveying distance of the sheet in the conveying unit between the feed unit and the registration unit is set to an integer multiple of a distance between a front edge of the precedent sheet and a front edge of the subsequent sheet to match the first timing and the second timing.

9. The apparatus according to claim 8, wherein the conveying distance is set to satisfy the integer multiple for a most frequently used size of the sheets from among a plurality of sizes of conveyable sheets.

10. The apparatus according to claim 7, wherein the feed unit is linked with a driving source at the second timing.

11. The apparatus according to claim 7, wherein the conveying unit is linked with a driving source at the first timing so as to bump the sheets to the registration unit.

12. The apparatus according to claim 7 wherein the conveying unit is provided with a conveying roller and a second electromagnetic clutch that links the conveying roller to the motor, and wherein the controller controls the first electromagnetic clutch and the second electromagnetic clutch to control that the first timing and the second timing matches.

* * * * *